United States Patent [19]

Berchtold et al.

[11] 4,324,526

[45] Apr. 13, 1982

[54] APPARATUS FOR REGULATING A TURBO-SUPERCHARGER

[75] Inventors: Max Berchtold, Küssnacht; Ernst Jenny, Baden, both of Switzerland

[73] Assignee: BBC Brown, Bovari & Company, Limited, Baden, Switzerland

[21] Appl. No.: 119,399

[22] Filed: Feb. 7, 1980

[30] Foreign Application Priority Data

Mar. 16, 1979 [CH] Switzerland ..... 2500/79

[51] Int. Cl.[3] ..... F01D 17/16

[52] U.S. Cl. ..... 415/48; 415/156; 415/158

[58] Field of Search ..... 415/48, 49, 151, 156, 415/157, 158; 60/602, 603

[56] References Cited

U.S. PATENT DOCUMENTS 2,861,774 11/1958 Buchi ..... 415/158
3,749,513 7/1973 Chute ..... 415/158
3,975,911 8/1976 Morqulis et al. ..... 415/158

FOREIGN PATENT DOCUMENTS 1084552 1/1955 France ..... 415/158

*Primary Examiner*—Louis J. Casaregola
*Attorney, Agent, or Firm*—Burns, Doane, Swecker & Mathis

[57] ABSTRACT

An apparatus for improving the efficiency of a turbo-supercharger at low load levels is disclosed. The apparatus includes an annular gas inlet housing which encircles the turbine of the turbo-supercharger and which housing includes an inlet for gases flowing toward the turbine. Arranged within the housing is a diaphragm, an outer periphery of which diaphragm is connected to the housing. Connected to the inner periphery of the diaphragm is a guide vane ring. Biasing springs, arranged within the housing, urge the diaphragm, and thus the guide vane ring connected to the diaphragm, toward the inlet.

16 Claims, 3 Drawing Figures

APPARATUS FOR REGULATING A TURBO-SUPERCHARGER

BACKGROUND AND SUMMARY OF THE PRESENT INVENTION

The invention disclosed herein pertains generally to turbo-superchargers and more particularly to an apparatus for regulating the inflow of engine exhaust gases to the turbine of a turbo-supercharger.

Due to the different operating characteristics of a combustion engine and a turbo-supercharger, it is difficult to achieve high effective mean pressures $p_{me}$ at reduced engine speeds. This difficulty increases with the degree of supercharging used.

The solutions hitherto proposed for overcoming this difficulty are expensive and have, therefore, not been used in the turbines of turbo-superchargers. These solutions include, for example, a turbine gas inlet housing which is constructed as a spiral, the cross-section of which spiral can be changed by means of an adjusting strap. This solution requires a not inconsiderable expenditure on structure, particularly with respect to obtaining satisfactory sealing of the strap.

An ideal solution would be a turbine with adjustable guide and rotor vanes. However, it has not yet been possible to implement a reliable and economically acceptable structure of this type.

Accordingly, a primary object of the present invention is to provide a relatively inexpensive apparatus for reliably and automatically regulating the cross-section of the turbine gas inlet at low engine speeds in order to achieve as high an efficiency as possible at low rates of flow of engine exhaust gases to the turbine.

Apparatus for regulating an inflow of engine exhaust gases to a turbine of a turbo-supercharger, according to the present invention, includes an annular diaphragm arranged within a gas inlet housing of the turbine. Connected to a lower portion of a front surface of the diaphragm is a guide vane ring. A first end of at least one spring is in contact with a back surface of the diaphragm, and a second end of the at least one spring is connected to a cover of the gas inlet housing. At relatively low engine speeds the spring biases the guide vane ring toward the gas inlet resulting in the guide vane ring filling substantially the entire gas inlet. At relatively high engine speeds, the relatively high pressures of the engine exhaust gases at the turbine inlet press the diaphragm, and the guide vane ring attached to the diaphragm, away from the turbine inlet. That is, the relatively high pressures of the exhaust gases at high engine speeds overcome the biasing force exerted by the spring.

An advantage of the present invention is that at low engine speeds the guide vanes of the guide vane ring force the engine exhaust gases to flow toward the rotor blades of the turbine at substantially the same relative angle as they flow at high engine speeds, when the diaphragm and the guide vane ring are pushed out of alignment with the turbine gas inlet. This results in a greater efficiency which enables a compressor driven by the turbine to force a greater amount of air into the engine, resulting in greater engine power at low engine speeds.

BRIEF DESCRIPTION OF THE DRAWINGS

Preferred embodiments of the present invention are described with reference to the accompanying drawings wherein like members bear like reference numerals and wherein.

DETAILED DESCRIPTION OF THE PREFERRED EMBODIMENTS

Figure 1:
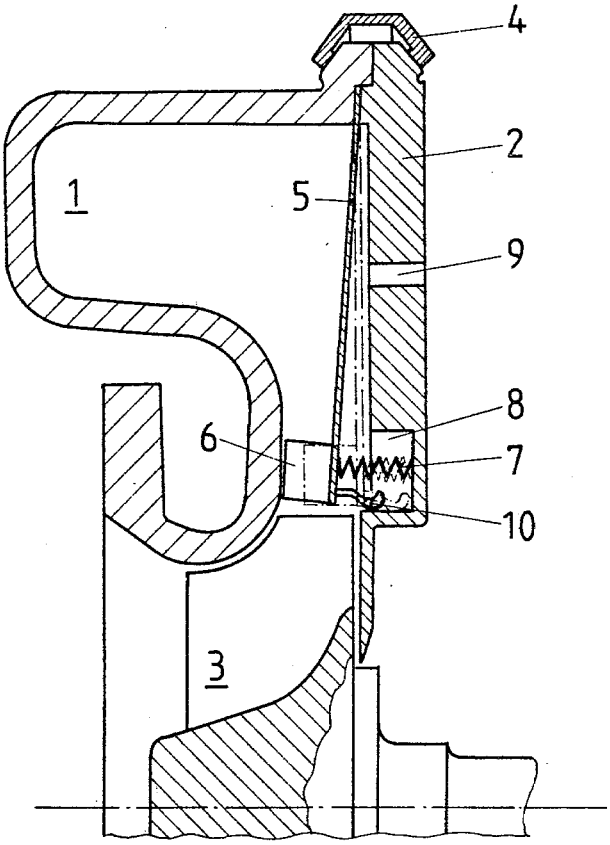
FIG. 1 is a cross-sectional view of a first preferred embodiment of apparatus, according to the present invention.

With reference to FIG. 1, a first preferred embodiment of apparatus, according to the present invention, for regulating an inflow of engine exhaust gases to a turbine of a turbo-supercharger, includes an annular gas inlet housing 1 having an S-shaped cross-section. Connected to an end of the gas inlet housing 1 is a housing cover 2 of a turbo-supercharger. The turbo-supercharger includes a radial turbine 3, which turbine is encircled by the gas inlet housing 1. The gases from the gas inlet housing 1 flow radially inwardly toward an axis of a shaft of the turbine 3. The gas inlet housing 1 and the housing cover 2 are joined to one another at their peripheries by a V-shaped clamping ring 4.

An annular diaphragm 5, arranged within the gas inlet housing 1, is clamped at its outer periphery between an outer flange of the gas inlet housing 1 and the housing cover 2. An inner periphery of the diaphragm 5 is substantially circular in shape and has a radius which is somewhat larger than the outer periphery of the turbine 3. The annular diaphragm 5 is arranged within the gas inlet housing 1 so as to encircle the turbine 3.

A guide vane ring 6 is connected to a front surface of the annular diaphragm 5, adjacent the inner periphery of the diaphragm. In contact with a back surface of the diaphragm 5 are the first ends of a plurality of springs 7 whose second ends are arranged in recesses 8 of the housing cover 2. When the turbine 3 is not rotating or is subjected to weak loading, the springs 7 press the diaphragm 5 toward the gas inlet housing 1 so that the guide vane ring 6 comes into contact with the housing 1. That is, under weak loading, the guide vane ring 6 fills substantially the entire cross-sectional area of the inlet. Thus, the exhaust gases are forced to flow through the guide vane ring 6 which presents a smaller cross-sectional area to flow than does the unobstructured inlet.

At low engine speeds, when the guide vane ring 6 fills substantially the entire cross-sectional area of the gas inlet, the guide vanes of the guide vane ring 6 direct the engine exhaust gases to flow toward the rotor blades of the turbine 3 at a relative angle to the rotor blades which is substantially the same as that at which the exhaust gases flow toward the turbine rotor blades when the engine is operating at relatively high speeds and the turbine is subjected to a relatively high load. This has the effect of increasing the effective mean pressure $p_{me}$. Thus, at relatively low loads, when the turbine 3 has to process a reduced flow of exhaust gases, the presence of the guide vane ring 6 in the gas inlet results in an increase in efficiency. That is, a compressor driven by the turbine is able to deliver a great amount of air to the engine, and thus the engine is able to deliver a greater amount of power, while engine speed remains unchanged. Of course, at high engine speeds the pressure exerted by the exhaust gases is sufficient to overcome the biasing force exerted by the springs 7, and to push the diaphragm 5 and the guide vane ring 6 out of alignment with the gas inlet.

In order to protect the diaphragm 5, which may, for example, be of thin spring elastic sheet metal, from being overheated by the exhaust gases, openings 9 are provided in the housing cover 2 through which cooling air, tapped from the compressor, may be conducted to the rear of the diaphragm. The flow of cooling air may be varied by known means, not shown, in order to adjust the diaphragm in whatever manner is desired. In order to seal the space behind the diaphragm with respect to the gas inlet housing 1, a sealing ring 10 or a metal bellows is connected to the back surface of the diaphragm 5, and arranged between the diaphragm 5 and the cover 2.

As shown in FIG. 1, the position of the diaphragm 5 when the gas inlet is fully open is drawn in dot-dashed lines. In this position the guide vane ring 6 no longer occupies most of the cross-sectional area of the gas inlet leading to the turbine 3.

Figure 2:
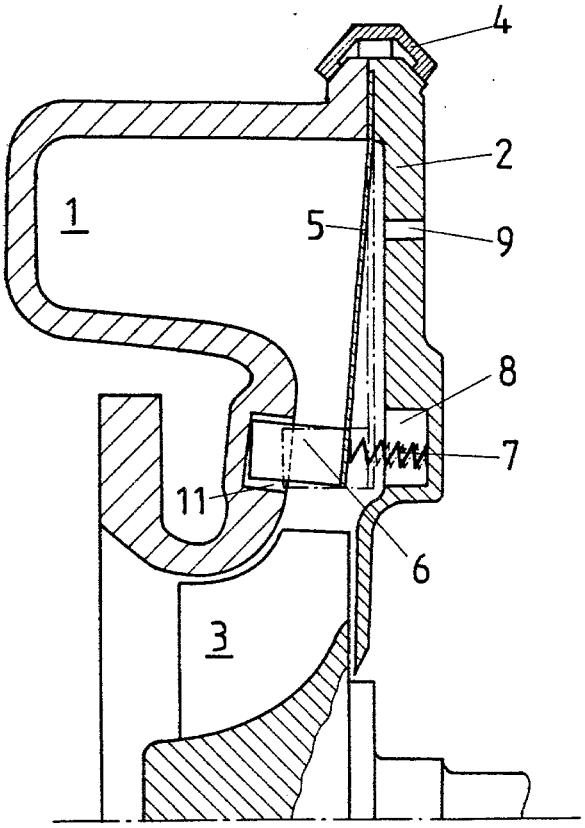
FIG. 2 is a cross-sectional view of a second preferred embodiment of apparatus, according to the present invention.

With reference to FIG. 2, a second preferred embodiment of apparatus, according to the present invention, for regulating an inflow of engine exhaust gas to the turbine 3, is essentially identical to the first embodiment. However, the second embodiment differs from the first embodiment in that a wall of the gas inlet housing 1 has an annular groove 11 which is sized to receive the guide vane ring 6. Thus, under a reduced-load condition, the springs 7 urge the guide vane ring 6 into the annular groove 11. When the gas inlet cross-section is fully open, that is in a high load condition, the guide vanes cover the whole inlet cross-section, as is shown in FIG. 2 by the dot-dashed lines. More advantageously, instead of the annular groove 11, recesses in the wall of the housing 1 may be provided for each individual vane, the cross-section of these recesses corresponding to the cross-section of the guide vanes. This prevents a lateral flow of gas around the guide vane ring 6 via the annular groove 11, which improves the action of the regulating device even more.

In the second embodiment, the open position of the guide vane ring 6 is a little farther to the right than in the first embodiment so that in the closed position a more advantageous inflow and better reduced-load efficiency is produced.

Figure 3:
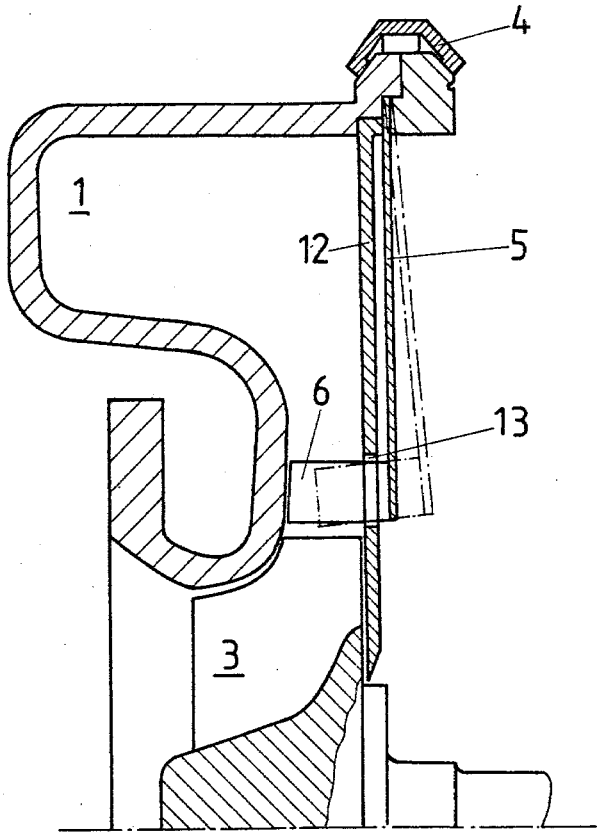
FIG. 3 is a cross-sectional view of a third preferred embodiment of apparatus, according to the present invention.

With reference to FIG. 3, a third preferred embodiment of apparatus, according to the present invention, is also similar to the first embodiment. The third embodiment differs from the first embodiment in that the diaphragm 5 is no longer arranged within the gas inlet housing 1. Rather, the diaphragm 5 is separated from the gas inlet housing by a partition 12. The partition 12 includes an aperture 13 through which the guide vane ring 6, attached to the diaphragm 5, may enter the gas inlet housing 1.

Although the third embodiment provides no improvement with respect to reduced-load efficiency over the first embodiment, the diaphragm 5 in the third embodiment is shielded against the flow of hot exhaust gases by the partition 12 so that special cooling of the diaphragm 5 can be omitted.

The diaphragm 5 can be actuated by a pressure medium, for example, the exhaust gas itself, which is introduced into the space delimited by the partition 12 and the diaphragm 5, or by any other mechanical, electric, magnetic, hydraulic or pneumatic means, which is also applicable to the other two embodiments, as alternatives to actuating the diaphragm by means of exhaust gas pressure. The diaphragm traverse can be derived, for example, from the engine speed or any other suitable operating value of the engine or of the turbo-supercharger.

The guide vanes can also be mounted at the gas inlet housing or alternatively at the housing and at the diaphragm.

A similar control of the inlet cross-sections is also possible with twin turbines, but with higher constructional outlay.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. Apparatus for regulating a turbo-supercharger, comprising:

a housing, which housing includes a gas inlet for the turbo-supercharger;

a diaphragm having an inner periphery and an outer periphery, which diaphragm is connected at its outer periphery to the housing, said inner periphery of said diaphragm being movable between a first position and a second position relative to said housing; and deflection means for deflecting a flow of gas within said inlet from a first flow angle to a second flow angle, said deflection means being provided at the inner periphery of the diaphragm.

2. Apparatus in accordance with claim 1 wherein said deflection means includes a guide vane ring.

3. Apparatus in accordance with claim 1 further comprising means for urging said inner periphery of said diaphragm toward said housing.

4. Apparatus in accordance with claim 2 further comprising:

a cover connected to said housing, the diaphragm being arranged within a space bounded by said housing and said cover; and spring means for resiliently urging said inner periphery of said diaphragm away from said cover.

5. Apparatus in accordance with claim 4 wherein said spring means includes a coil spring received within a recess of said cover.

6. Apparatus in accordance with claim 4 further comprising means for supplying a cooling gas to said diaphragm.

7. Apparatus in accordance with claim 4 further comprising means for sealing said inner periphery of said diaphragm with respect to the cover.

8. Apparatus in accordance with claim 2 further comprising an annular groove within a wall of said housing, which groove is adjacent said inlet, and which groove is sized to receive said guide vane ring.

9. Apparatus in accordance with claim 1 wherein said diaphragm defines one wall of said gas inlet.

10. Apparatus in accordance with claim 1 further comprising partition means for defining said gas inlet with said housing, said diaphragm being provided outside of said gas inlet.

11. Apparatus in accordance with claim 4 wherein said outer periphery of said diaphragm is clamped between said housing and said cover.

12. Apparatus in accordance with claim 1 wherein said diaphragm is flexible.

13. Apparatus for regulating a turbo-supercharger, comprising:

a turbo-supercharger which includes a turbine;

a housing encircling said turbine;

a cover having an outer periphery, which cover is connected at its outer periphery to the housing, and which cover and housing define an annular space about the turbine;

an annular diaphragm arranged within said annular space, which diaphragm includes an inner periphery and an outer periphery, and which diaphragm is clamped at its outer periphery to said housing and said cover, and which diaphragm is movable between a first position and a second position relative to said housing;

said diaphragm and said housing defining a gas inlet for the turbine;

a guide vane ring, connected to the inner periphery of said diaphragm adjacent said inlet; and means for urging said inner periphery of said diaphragm toward said housing.

14. Apparatus in accordance with claim 13 further comprising an annular groove within a wall of said housing, which groove is adjacent said inlet, and which groove is sized to receive said guide vane ring.

15. Apparatus for regulating a turbo-supercharger, comprising:

a turbo-supercharger which includes a turbine;

a housing encircling said turbine;

a partition having an outer periphery, which partition is connected at its outer periphery to the housing, and which partition defines a boundary between an interior of the housing and the exterior;

said partition and said housing defining a gas inlet for the turbine;

an annular diaphragm having an inner periphery and an outer periphery, which diaphragm is connected at its outer periphery to the housing, and which diaphragm is arranged outside the interior of the housing; and a guide vane ring, connected to the inner periphery of the diaphragm, and which guide vane ring protrudes through an opening in the partition into the interior of the housing, adjacent the inlet.

16. Apparatus for regulating a turbo-supercharger, comprising:

a housing, which housing includes a gas inlet for the turbo-supercharger;

a diaphragm having first and second ends, which diaphragm is connected at its first end to the housing, said second end of said diaphragm being movable between a first position and a second position relative to said housing; and deflection means for deflecting a flow of gas within said inlet from a first flow angle to a second flow angle, said deflection means being provided at the second end of said diaphragm.

* * * * *